US008487168B1

(12) United States Patent
Klukosky et al.

(10) Patent No.: US 8,487,168 B1
(45) Date of Patent: Jul. 16, 2013

(54) METHOD FOR MANUFACTURING COATED STRINGS INCLUDING GLOW IN THE DARK STRINGS

(75) Inventors: Thomas Klukosky, West Milford, NJ (US); Mark Dronge, Tenafly, NJ (US)

(73) Assignee: DR Music, Inc., Emerson, NJ (US)

( * ) Notice: Subject to any disclaimer, the term of this patent is extended or adjusted under 35 U.S.C. 154(b) by 0 days.

(21) Appl. No.: 13/108,557

(22) Filed: May 16, 2011

Related U.S. Application Data

(60) Provisional application No. 61/334,676, filed on May 14, 2010, provisional application No. 61/385,106, filed on Sep. 21, 2010.

(51) Int. Cl.
*G10D 3/10* (2006.01)

(52) U.S. Cl.
USPC ..... 84/297 S

(58) Field of Classification Search
USPC ..... 84/297 S
See application file for complete search history.

(56) References Cited

U.S. PATENT DOCUMENTS

| | | | | | |
|---|---|---|---|---|---|
| 2,241,282 | A * | 5/1941 | Wackerle | 84/297 S |
| 2,710,557 | A * | 6/1955 | Sundt | 84/297 S |
| 3,099,595 | A * | 7/1963 | Allbaugh | 156/172 |
| 3,120,144 | A * | 2/1964 | Bayer | 84/199 |
| 4,202,241 | A * | 5/1980 | Lucas | 84/422.4 |
| 4,342,814 | A * | 8/1982 | Usuki et al. | 428/383 |
| 5,408,911 | A * | 4/1995 | Weiss et al. | 84/297 S |
| 5,565,240 | A * | 10/1996 | Smith | 427/195 |
| 5,789,021 | A * | 8/1998 | Dooms et al. | 427/64 |
| 6,248,942 | B1 * | 6/2001 | Hebestreit et al. | 84/297 S |
| 6,528,709 | B2 * | 3/2003 | Hebestreit et al. | 84/297 S |
| 7,476,791 | B2 * | 1/2009 | Parker | 84/297 S |
| 7,687,699 | B2 * | 3/2010 | Briggs et al. | 84/422.4 |
| 7,687,700 | B1 * | 3/2010 | Torres | 84/422.4 |
| 7,714,217 | B2 * | 5/2010 | Nesbitt | 84/297 S |
| 7,714,218 | B2 * | 5/2010 | Papenfus | 84/314 R |
| 7,820,897 | B2 * | 10/2010 | Tambara et al. | 84/297 S |
| 7,923,617 | B2 * | 4/2011 | Nesbitt | 84/297 S |
| 8,183,448 | B2 * | 5/2012 | Mueller-Zierach et al. | 84/297 S |
| 8,362,344 | B2 * | 1/2013 | Nesbitt | 84/297 S |
| 2003/0196538 | A1 * | 10/2003 | Katchanov et al. | 84/297 S |
| 2004/0255751 | A1 * | 12/2004 | Schlesinger | 84/297 S |
| 2005/0241454 | A1 * | 11/2005 | Parker | 84/1 |
| 2007/0080623 | A1 * | 4/2007 | Iimura | 313/483 |
| 2007/0163420 | A1 * | 7/2007 | Reiss et al. | 84/329 |
| 2009/0158912 | A1 * | 6/2009 | Nesbitt | 84/297 S |
| 2010/0071530 | A1 * | 3/2010 | Mueller-Zierach et al. | 84/297 S |
| 2010/0095827 | A1 * | 4/2010 | Rheinnecker et al. | 84/297 S |
| 2010/0199830 | A1 * | 8/2010 | Nesbitt | 84/297 S |
| 2010/0294109 | A1 * | 11/2010 | Rieger | 84/297 S |

* cited by examiner

*Primary Examiner* — David Warren
*Assistant Examiner* — Robert W Horn
(74) *Attorney, Agent, or Firm* — Brian Roffe

(57) ABSTRACT

Method for forming a musical instrument string and string formed thereby in which a core wire having a coating thereon is formed and a wrap wire is wound around the coated core wire. Musical instrument string that glows in the dark and may be formed by providing a first wire that will serve as a core wire of the string, providing a second wire that will serve as a wrap wire of the string, applying a thermoplastic or thermosetting luminescent polymer to the second wire, e.g., by electrostatic application, and then curing the second wire, controlling the curing conditions under which the second wire is cured to ensure the second wire, after curing is windable, and then winding the cured, second wire around the first wire to provide the string that glows in the dark.

14 Claims, 3 Drawing Sheets

METHOD FOR MANUFACTURING COATED STRINGS INCLUDING GLOW IN THE DARK STRINGS

CROSS-REFERENCE TO RELATED APPLICATIONS

This application claims priority under 35 U.S.C. §119(e) of U.S. provisional patent application Ser. Nos. 61/334,676 filed May 14, 2010 and 61/385,106 filed Sep. 21, 2010, both of which are incorporated by reference herein.

FIELD OF THE INVENTION

The invention relates generally to a method for manufacturing coated strings for musical instruments, and musical instrument strings manufactured by such methods.

The invention also relates generally to a method for manufacturing strings for musical instruments that glow in the dark, and musical instrument strings manufactured by such methods.

BACKGROUND OF THE INVENTION

There are several known methods for manufacturing coated strings, some of which are described below (all of the mentioned patent literature is incorporated by reference herein). U.S. Pat. No. 4,539,228 (Lazarus) describes a method of treating metal musical instrument strings including wound strings to reduce break-in period and extend useful lifetime. The method includes cleaning the strings to remove abrasive particles, and filling microscopic pores, cavities and crevices of the strings and the interstices of wound strings with dry lubricant particles. The wound strings are soaked in a liquid Teflon®, polytetrafluoroethylene in a liquid carrier, for days to get the Teflon® between the wrap wire and the core wire.

U.S. Pat. No. 5,883,319 (Hebestreit et al.) describes a musical instrument string including a polymer cover that protects the string from contamination while also making the string easier to play. The cover comprises at least one layer of expanded polytetrafluoroethylene (ePTFE) that is sealed with a polymer coating.

U.S. Pat. No. 6,765,136 (Van Pamel) describes a method wherein a hydrophobic polymer is adhesively coated on the surfaces of a wound string within its interstitial voids, while the exterior surfaces remain uncoated. The polymer is applied by soaking the string in a liquid polymeric solution to flow the solution into the interstitial voids. The string is removed from the bath and the residual solution is removed from the exterior surface of the string using a resilient scraper. The string is hung to dry for 8 hours in a clean room environment at ambient temperatures and, more preferably, maintained at a temperature of between 20° C. and 25° C. Alternatively, the string is treated by a combination of heat and drying.

U.S. Pat. Appln. Publ. No. 2004/0255751 (Schlesinger) describes a method for coating musical instrument strings by treating the strings with a polymer vapor. The treatment may be applied to the core of the strings, to strands wrapped around the core, or both. The treatment may be applied either before or after wrapping the strands around the core.

Stringed musical instruments are often played in dark environments thereby requiring the players to either feel the strings in order to ensure that their fingers are correctly placed thereon or move to a lighted area to see the strings more clearly.

As such, it has been considered to include luminescent materials in musical instrument strings. For example, U.S. Pat. Appln. Publ. No. 2003/1096538 (Katchanov et al.) describes musical instrument strings for guitars and the like having longitudinal wrappings and/or surface contours to provide improved tactile response without adversely affecting the string tonal quality or producing undesirable noise. The musical instrument strings may have cores of metal wire, or may be composed of a synthetic material having a longitudinally contoured exterior surface and optionally a core impregnated with either a non-random dispersion of additive particles. Further, the strings 100 may be made of synthetic finer (plastic) that include additive particles as shown in FIGS. 7A-7C, wherein the additive particles may be a coloring agent or luminescent materials such as those that glow in the dark.

Instead of incorporating luminescent material in the strings, it has been conceived to added a luminescent compound to a bow that interacts with strings, e.g., U.S. Pat. No. 6,280,654 (Digman et al.). Instead of adding the luminescent compound to the bow, U.S. Pat. No. 5,977,462 (Wolfson) describes a fret board having indicators that indicate the pitch produced when the string is pressed down, wherein the indicators may be colored, fluorescent and/or include any discernible characteristic that is discernible by sight.

There is always a need to improve the manner in which musical instrument strings are coated and the invention provides an improvement over the cited prior art.

Moreover, a new method for incorporating luminescent compounds into musical instrument strings is needed which provides better manufacturing capabilities than the prior art methods.

SUMMARY OF THE INVENTION

One embodiment of a method for forming a musical instrument string that glows in the dark comprises providing a first wire that will serve as a core wire of the string, providing a second wire that will serve as a wrap wire of the string, applying a thermoplastic or thermosetting luminescent polymer to the second wire, e.g., by electrostatic application, and then curing the second wire, controlling the curing conditions under which the second wire is cured to ensure the second wire, after curing is windable, and then winding the cured, second wire around the first wire to provide the string that glows in the dark.

The application of the thermoplastic or thermosetting luminescent polymer to the second wire and then curing of the second wire may entail applying a dry powder including the thermoplastic or thermosetting luminescent polymer to an uncoated second wire to form a powdered wire, directing the powdered wire into a curing oven, and maintaining the powdered wire in the curing oven for a specific period of time to cause curing of the dry powder onto the uncoated second wire to thereby form the cured, second wire with the coating thereon.

The time to maintain the powdered wire in the curing oven may be determined based on a diameter of the powdered wire and a temperature of the curing oven.

A musical instrument string that glows in the dark that may formed by the method above includes a core wire and at least one wrap wire wound around the core wire. One or more of the wrap wires is formed from a cured wire to which a thermoplastic or thermosetting luminescent polymer is applied such that the wrap wire glows in the dark. The wrap wire may be formed by applying a dry powder to an uncoated wrap wire to form a powdered wire, directing the powdered wire into a curing oven, and maintaining the powdered wire in the curing oven for a specific period of time to cause curing of the dry powder onto the uncoated wrap wire to thereby form the wrap wire with the cured coating thereon.

Another embodiment of the invention relates to coating of the core wire, and not the wrap wire. A method for forming a musical instrument string in accordance with this embodiment includes forming a core wire having a coating thereon, and winding a wrap wire around the coated core wire. Forming the core wire may entail applying a dry powder to an uncoated core wire to form a powdered wire, directing the powdered wire into a curing oven, and maintaining the powdered wire in the curing oven for a specific period of time to cause curing of the dry powder onto the uncoated core wire to thereby form the core wire with the coating thereon. The time for which the powdered wire is maintained in the curing oven may be determined based on a diameter of the powdered wire and a temperature of the curing oven. The dry powder may be electrostatically applied to the uncoated core wire.

Another method for forming musical instrument strings in accordance with the invention includes providing core wires and wrap wires having the same diameter, applying powder to the core wires and wrap wires, directing the powdered core wires and wrap wires into a curing oven, maintaining the powdered core wires and wrap wires in the curing oven for a specific period of time to cause curing of the powder and thereby form coated wires, and determining the time to maintain the powdered core wires in the curing oven to be less than the time the powdered wrap wires are maintained in the curing oven to thereby form a harder coating on the core wires than on the wrap wires. Then, the core wires and wrap wires are usable to form musical instrument strings including at least one coated core wire or coated wrap wire. For example, one of the wrap wires may be wound around one of the core wires, or an uncoated wrap wire may be wound around one of the coated core wires.

A musical instrument string may be formed from any of the above methods and comprises a core wire having a cured coating thereon, and a wrap wire wound around the core wire. Thus, the core wire is formed by applying a dry powder to an uncoated core wire to form a powdered wire, directing the powdered wire into a curing oven, and maintaining the powdered wire in the curing oven for a specific period of time to cause curing of the dry powder onto the uncoated core wire to thereby form the core wire with the cured coating thereon.

Other and further objects, advantages and features of the present invention will be understood by reference to the following specification in conjunction with the annexed drawings, wherein like parts have been given like numbers.

BRIEF DESCRIPTION OF THE DRAWINGS

The invention, together with further objects and advantages thereof, may best be understood by reference to the following description taken in conjunction with the accompanying drawings wherein like reference numerals identify like elements.

DETAILED DESCRIPTION OF THE INVENTION

Figure 1:
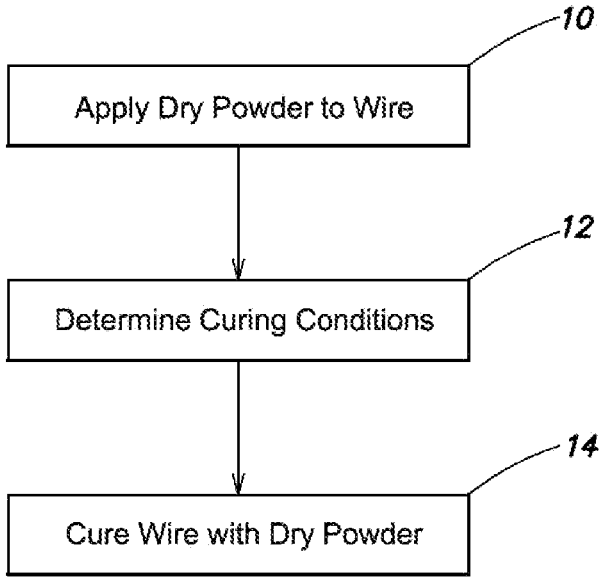
FIG. 1 is a flow chart showing the basic steps of a method in accordance with the invention.

Referring to the accompanying drawings wherein like reference numerals refer to the same or similar elements, FIG. 1 is a flow chart showing main steps in a method for coating musical string wires.

In a first embodiment of the invention, the method is designed to provide a hard coating on the core wire of the string, yet still enable a string including the coated core wire to be sufficiently flexible to enable its proper use. That is, the coating method is performed before any wrap wires are wound about the core wire.

Generally, the core wire will be coated with one or more thermoplastic and thermosetting luminescent polymers including, but not limited to, polyurethane, TGIC, RAL TGIC (epoxy/polyester hybrid), polyester, epoxy, urethane and acrylics, and combinations thereof.

Figure 2:
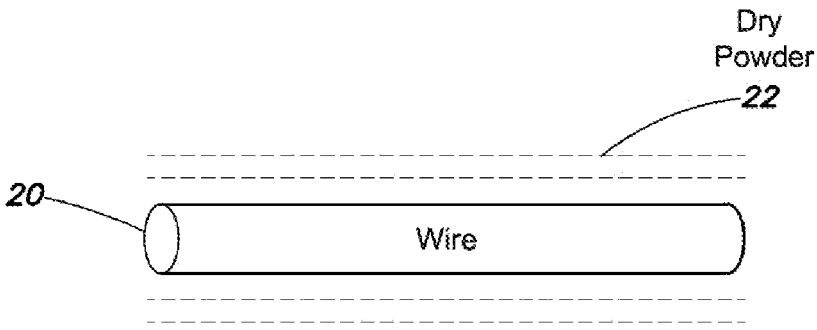
FIG. 2 shows a wire with dry powder thereon.

A preferred coating method is depicted in FIG. 1 and is a powder coating process. In an exemplifying powder coating process, the first step 10 is to electrostatically apply a dry powder 22 to the wire 20 (see FIG. 2), then determine the conditions for curing the wire having the electrostatically applied dry powder, step 12, and then cure the wire 20 having the electrostatically applied dry powder under heat for a specific time depending on the gauge of wire 20, step 14. Electrostatic application of a dry powder to a wire is a known technique to those skilled in the art, details of which are set forth in the Voelker et al. patent mentioned above. Instead of an electrostatic coating method, other coating methods may be used in accordance with the invention.

The process conditions under which the wire 20 with the electrostatically applied dry powder is cured vary. Typically, the wire is coated with a film of dry powder between about 0.0002 inches and about 0.001 inches and then cured at a temperature between about 400° F. and about 650° F. for approximately 30 seconds to about 60 seconds in order to provide a suitable cure for the dry powder in the wire. The particular cure conditions can be determined in a research stage and a table of the cure condition as a function of the parameters of the wire and/or dry powder created. This table is then stored and used in the manufacturing stage to enable the manufacturing personnel to obtain the parameters of the wire, e.g., measure the wire, and then retrieve the cure conditions to use in the curing stage.

An important aspect of the invention lies in the determination of the curing time. It has been found that it is especially advantageous that the curing time of the core wire can be as little as 34.6 seconds, or no more than 50 seconds, i.e., a range of about 34.6 seconds to about 50 seconds. The exact cure time is a function of the diameter of the core wire so that a core wire with a diameter of 0.006 inches would be cured for 34.6 seconds and a core wire with a diameter of 0.025 inches would be cured for 50 seconds. These times may vary depending on, for example, the curing temperature and the color of the wire.

The inventors know of no other process for manufacturing musical instrument strings wherein the core wire is cured after application of a dry powder thereto. Rather, the prior art known to the inventor, including that mentioned above, deals solely with curing of the wrap wire and the conditions for use of the wrap wire differ fundamentally from those of the core wire. Among other things, the wrap wire is the outermost wire that is handled and contacted by the musician during use of the strings and this contact with the musician imposes different requirements on the surface of the wrap wire than on the core wire which is not handled at all by the musician during use. Yet another difference is that the wrap wire is coiled about the core wire and this coiling imposes significant constraints on the properties of the wrap wire, i.e., it must remain sufficiently flexible and pliable to bend in tight spirals about the core wire, whereas the requirements for flexibility and pliability of the core wire are much less because the core wire maintains its elongate condition and is not bend in spirals. Still another difference is that major portions of the wrap wire are exposed to the ambient atmosphere as it is the outermost wire of the musical instrument string and this exposure also imposes requirements on its surface properties. By contrast, the core wire is mostly enclosed or enwrapped by the wrap wire and therefore has much less exposure to the ambient atmosphere.

In view of the foregoing, the time to cure a wrap wire is higher than the time to cure a core wire in accordance with the invention because a softer wrap wire is needed and this softness is achieved by increasing the cure time, Thus, a range of a cure time for a wrap wire is about 39.1 second to about 64.3 seconds. As explained above when describing curing of a core wire, the exact cure time for a wrap wire is a function of the diameter of the wrap wire so that a wrap wire with a diameter of 0.006 inches would be cured for 50 seconds and a wrap wire with a diameter of 0.025 inches would be cured for 64.3 seconds. These times may vary depending on, for example, the curing temperature and the color of the wire.

It can therefore be appreciated that for the same diameter wire, and under the same curing conditions, e.g., temperature and color to be imparted to the wire, the curing time for a core wire is about 10%-22% less than the curing time for a wrap wire. The shorter curing time results in a harder wire.

To reiterate, one reason that enables the method in accordance with the invention to be practiced with the shorter curing time is that the method is applied only to the core wire of a musical instrument string which is not exposed and touched by the player of the musical instrument to which the strings are mounted. On the other hand, when either a musical instrument string in its entirety, i.e., including a core wire and one or more wrap wires wound thereon, is coated by being subject to a coating process after the wrap wire is wound about the core wire, or only the wrap wires are coated, it seems to be necessary to provide for the longer curing time in order to ensure that the string or wire will be sufficiently soft and flexible to account for its contact by the player.

There are additional advantages of the coating of the core with in accordance with the invention, independent of any coating of any wrap wires. These advantages include improved corrosion resistance between the core wire and outer wrap wire of the wound musical string. Strings without a coating corrode quickly as a result of two different metals reacting together by themselves and this corrosion is accelerated when the strings are subjected to human sweat and oils. Therefore, by coating the core wire, the coating is interposed between the core wire and any wrap wire that comes into contact with the coated core wire and the coating thus serves to inhibit any corrosion of the core wire.

Another advantage of a string with a coated core wire in accordance with the invention is that inconsistencies of sound, that might arise from inconsistencies of the metal core wire, even out. The effects of this are that the strings go into tune faster and more consistently, the sound produced by the strings is louder and clearer, the strings do not have any dead spots, intonation is greatly improved, unwanted and out of key overtones are reduced dramatically, bending to notes that would be dead with a conventional string, and drop down tuning is easier and more accurate.

Yet another advantage of a string with a coated core wire in accordance with the invention is that because of the hardness and the consistencies of the coating, the string can be bent to higher notes with less of a bend, and less effort. Some notes can be reached that were either not practical or unattainable because of the effort or interference with other strings being played.

The following table shows the variation in curing time for core and wrap wires, wherein the wires have the same diameters and are subject to the same curing conditions:

| Diameter (inches) | Core wire curing time (seconds) | Curing Temperature (° F.) | Wrap wire curing time (seconds) | Final wire diameter (inches) |
|---|---|---|---|---|
| 0.006 | 34.6 | ~400 | 39.1 | 0.007 |
| 0.025 | 50 | ~650 | 64.3 | 0.026 |

Figure 3:
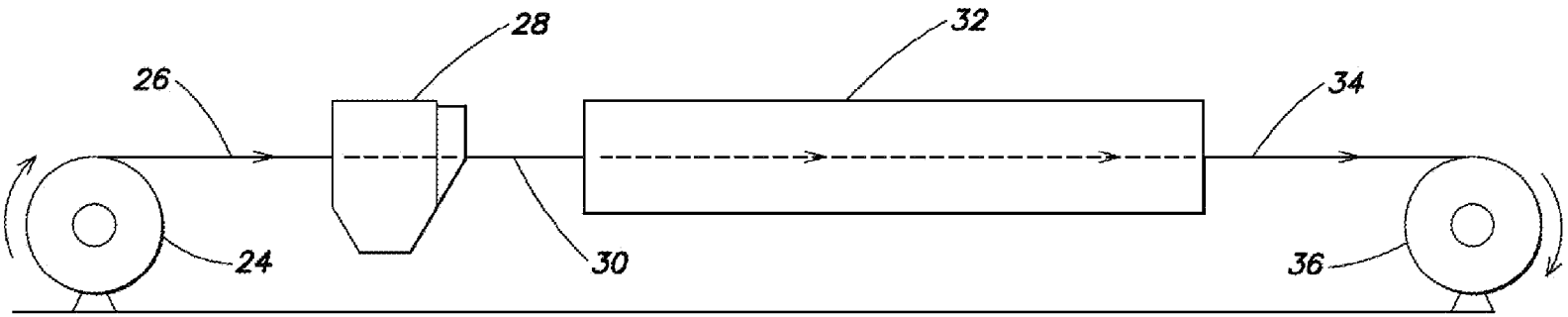
FIG. 3 is a schematic of a system that forms coated wires in accordance with the invention.

Referring now to FIG. 3, a system that coats core wires in accordance with the invention is shown and includes a payout spool 24 on which the core wire is wound. The payout spool is controlled by a controller, not shown, to unwind the uncoated core wire 26 at a controlled rate. The uncoated core wire 26 enters into an electrostatic coating machine 28 to receive, for example, dry powder thereon that will form the coating after curing. The powdered wire 30 is then passed into a curing oven or other comparable curing device 32 to be cured. The finished coated wire 34 is then wound about a take-up spool 36.

The speed of the unwinding of the uncoated core wire 26 from the payout spool 24 and winding of the coated wire 34 about the take-up spool 36 is controlled to ensure that the powdered wire 30 remains in the curing oven 32 for the desired curing time (discussed above). This curing time is selected depending on several factors, primarily the diameter of the uncoated wire 26 and the temperature of the curing oven 32. Also, the curing time is less than the curing time for curing a wrap wire having the same diameter and being cured at the same curing temperature in a curing oven, to thereby provide the core wire with a harder surface than a same diameter wrap wire cured under the same curing conditions.

After the coated core wire is formed about the take-up spool 36, it can be moved into another position to be used as the core wire of a musical string. That is, with reference to FIG. 4, the core wire 38, with the coating 40 thereon, is drawn from the take-up spool 36 and a wrap wire 42 is wound about coated core wire 38 to form the musical instrument string in accordance with the invention. The equipment that coils the wrap wire 42 around the coated core wire is not shown and may be any conventional equipment known to those skilled in the musical instrument string field. Moreover, more than one wrap wire may be used.

In another embodiment of the invention, it is the wrap wire that is coated with a particular type of material to cause the coated wrap wire to glow in the dark. Thus, instead of or in addition to coating the core wire as in embodiments described above, FIG. 1 may represent a flow chart showing main steps in a method for applying a glow in the dark and/or luminescent/fluorescent hard flexible coating on a musical string wire, namely a wrap wire. In a similar manner, FIG. 3 may depict an apparatus for manufacturing a coated wrap wire in accordance with the invention.

Generally, the wrap wire will be coated with one or more thermoplastic and thermosetting luminescent polymers including, but not limited to, polyurethane, TGIC, RAL TGIC (epoxy/polyester hybrid), polyester, epoxy, urethane and acrylics, and combinations thereof. The particular compound selected may depend on experimental results relating to, for example, the durability and brightness of the wrap wires.

In an exemplifying powder coating process, the wire to which the dry powder is electrostatically applied is the wrap wire that will be the outermost wire of the string (as there may be more than one wrap wire around the core wire). After curing, the wire coating will cause the wire to glow in the dark and or glow under lighting conditions such as a black light. Thus, when the wrap wire is wound about a core wire, or about another wrap wire previously wound about a core wire, the string formed from the core wire and wrap wire will glow in the dark.

An additional advantage of the coating of the wrap wire is that the coating provides corrosion resistance for longer life.

Since the coated wrap wire must be wound around a core wire, or around another wrap wire that is wound around a core wire, the coated wrap wire that will provide the glow in the dark characteristics must be sufficiently bendable. To this end, the curing is controlled to ensure such bendability, e.g., with a shorter cure time which results in a more bendable wire, with remaining cure conditions the same. Other properties of the curing, e.g., temperature, may also be controlled to cure the coating yet also provide a sufficiently bendable wire.

Figure 4:
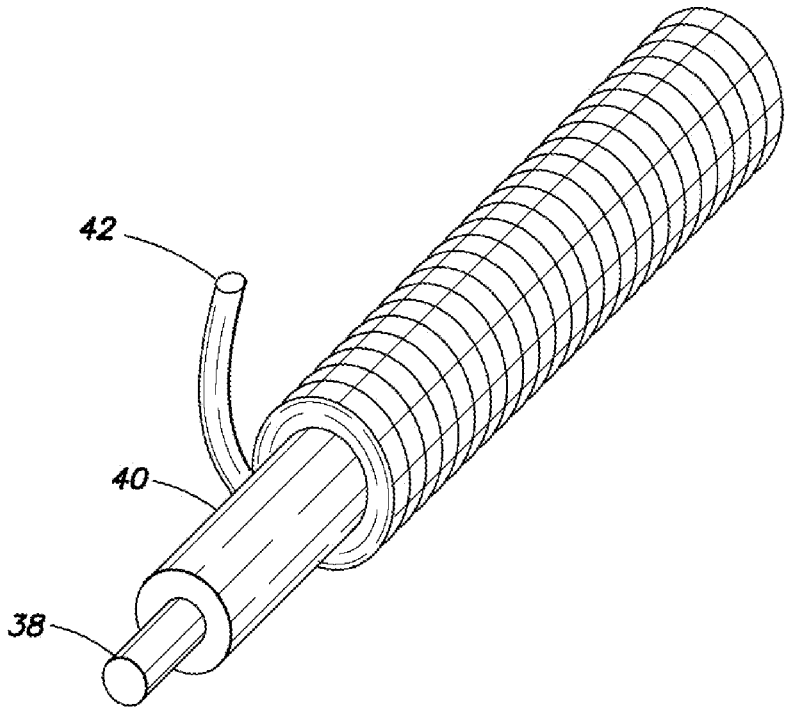
FIG. 4 shows a stage in the manufacture of a musical instrument string using a core wire formed in accordance with the invention.

Applying FIG. 4 to this embodiment wherein the wrap wire is coated with a polymer that when cured will cause it to glow in the dark, the core wire 38, with or without a coating 40 thereon, is drawn from the take-up spool 36 and the coated wrap wire 42 is wound about the core wire 38 to form the musical instrument string in accordance with the invention. The equipment that coils the wrap wire 42 around the core wire is not shown and may be any conventional equipment known to those skilled in the musical instrument string field. Moreover, more than one wrap wire may be used.

Coating of the core wire 38 to provide a hard core thereto, is independent of the coating of the wrap wire to cause it glow in the dark. Thus, in a string manufactured in accordance with the invention, only the core wire may be coated, only one or more of the wrap wires may be coated, or both the core wire and one or more of the wrap wires may be coated.

Another type of string that may be made as a glow in the dark string in accordance with the invention is a string that is only a single, plain string, i.e., it is not formed from a wrap wire wound about a core wire. In this case, the glow in the dark wire is manufactured as described above, i.e., coated and then cured, and its curing characteristics may be selected without regard to the need to wrap the wire.

A set of glow in the dark wires in accordance with the invention may include 1-3 of the plain wires, i.e., straight wires that are made to glow in the dark as described above, and the remaining wires may be wires formed from glow in the dark wrap wires around core wires. Various combinations of such wires, with variations in size, may be included in sets for different musical instruments, e.g., electric guitars.

The foregoing details a method for manufacturing coated strings for musical instruments, and musical instrument strings manufactured by such methods, as well as a method for manufacturing strings for musical instruments that glow in the dark, and musical instrument strings manufactured by such methods.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A method for forming musical instrument strings, comprising:

providing core wires and wrap wires having the same diameter;

applying powder to the core wires and wrap wires;

directing the powdered core wires and wrap wires into a curing oven;

maintaining the powdered core wires and wrap wires in the curing oven for a specific period of time to cause curing of the powder and thereby form coated wires; and determining the time to maintain the powdered core wires in the curing oven to be less than the time the powdered wrap wires are maintained in the curing oven to thereby form a harder coating on the core wires than on the wrap wires, whereby the core wires and wrap wires are usable to form musical instrument strings including at least one coated core wire or coated wrap wire.

2. The method of claim 1, wherein the step of applying powder to the core wires comprises electrostatically applying a dry powder to the uncoated core wires.

3. The method of claim 1, further comprising winding one of the wrap wires around one of the core wires to form a musical instrument string.

4. The method of claim 1, further comprising winding an uncoated wrap wire around one of the coated core wires to form a musical instrument string.

5. The method of claim 1, wherein the step of applying powder to the wrap wires comprises electrostatically applying a dry powder to the uncoated wrap wires.

6. The method of claim 1, further comprising winding a coated wrap wire around one of the uncoated core wires to form a musical instrument string.

7. A method for forming a musical instrument string with a coating that glows in the dark, comprising:

providing a first wire that will serve as a core wire of the string;

providing a second wire that will serve as a wrap wire of the string;

applying a single layer of thermoplastic luminescent polymer or of thermosetting luminescent polymer to the second wire and then curing the second wire by heating the second wire in its entirety to cause the second wire in its entirety to be luminescent;

controlling the curing conditions under which the second wire is cured to ensure the second wire, after curing is windable; and then winding the cured, second wire around the first wire to provide the string that glows in the dark.

8. The method of claim 7, wherein the step of applying a thermoplastic luminescent polymer or a thermosetting luminescent polymer to the second wire and then curing the second wire comprises:

applying a dry powder including the thermoplastic luminescent polymer or the thermosetting luminescent polymer to an uncoated second wire to form a powdered wire; directing the powdered wire into a curing oven; and maintaining the powdered wire in the curing oven for a specific period of time to cause curing of the dry powder onto the uncoated second wire to thereby form the cured, second wire with the coating thereon.

9. The method of claim 8, further comprising determining the time to maintain the powdered wire in the curing oven based on a diameter of the powdered wire and a temperature of the curing oven.

10. The method of claim 8, wherein the step of applying the dry powder to the uncoated second wire comprises electrostatically applying the dry powder to the uncoated second wire.

11. A musical instrument string with a coating that glows in the dark, comprising:

a core wire; and a wrap wire wound around said core wire, said wrap wire comprising a single layer coating being formed from a thermoplastic luminescent polymer or a thermosetting luminescent polymer applied prior to curing such that said cured wrap wire in its entirety glows in the dark.

12. A method for forming a musical instrument string with a coating that glows in the dark, comprising:

providing a wire;

applying a single layer of dry powder including a thermoplastic luminescent polymer or a thermosetting luminescent polymer to the wire to form a powdered wire;

directing the powdered wire into a curing oven;

heating the powdered wire in its entirety in the curing oven; and maintaining the powdered wire in the curing oven for a specific period of time to cause curing of the dry powder onto the wire to thereby form a cured wire with a luminescent single layer coating thereon, the cured wire in its entirety being luminescent, whereby the cured wire is usable without an overlying wrap wire on the musical instrument.

13. The method of claim 12, further comprising determining the time to maintain the powdered wire in the curing oven based on a diameter of the powdered wire and a temperature of the curing oven.

14. The method of claim 12, wherein the step of applying the dry powder to the wire comprises electrostatically applying the dry powder to the wire.

* * * * *